United States Patent [19]

Dickenson et al.

[11] Patent Number: 4,876,023

[45] Date of Patent: Oct. 24, 1989

[54] LAUNDRY PRODUCTS

[75] Inventors: Haydn G. W. Dickenson; David H. Huntington, both of Newcastle upon Tyne, England

[73] Assignee: The Procter & Gamble Company, Cincinnati, Ohio

[21] Appl. No.: 195,062

[22] Filed: May 17, 1988

[30] Foreign Application Priority Data

May 23, 1987 [GB] United Kingdom ..... 8712285

[51] Int. Cl.[4] ..... C11D 17/00

[52] U.S. Cl. ..... 252/90; 252/92; 252/174; 206/0.5

[58] Field of Search ..... 252/90, 91, 92, 93, 252/174; 206/0.5; 428/35; 427/366

[56] References Cited

U.S. PATENT DOCUMENTS

| | | | |
|---|---|---|---|
| 4,188,304 | 2/1980 | Clarke et al. | 252/93 |
| 4,348,293 | 9/1982 | Clarke et al. | 252/90 |
| 4,391,723 | 7/1983 | Bacon et al. | 252/90 |
| 4,530,874 | 7/1985 | Hendrix et al. | 427/366 |
| 4,555,354 | 11/1985 | Clarke et al. | 252/90 |
| 4,745,021 | 5/1988 | Ping, III et al. | 428/35 |

FOREIGN PATENT DOCUMENTS

| | | |
|---|---|---|
| 0011501 | 5/1980 | European Pat. Off. . |
| 0011502 | 5/1980 | European Pat. Off. . |
| 0039527 | 11/1981 | European Pat. Off. . |
| 0066463 | 12/1982 | European Pat. Off. . |
| 48-36249 | 5/1973 | Japan . |
| WO80/01079 | 5/1980 | World Int. Prop. O. . |

*Primary Examiner*—Paul R. Michl
*Assistant Examiner*—Hoa Van Le
*Attorney, Agent, or Firm*—Robert B. Aylor; Richard C. Witte

[57] ABSTRACT

A laundry product comprising a particulate laundry composition releasably contained within a closed, single- or multi-compartment sachet having a frangible seal, in which the sachet is formed of water-insoluble, calender-bonded or calender-finished, non-woven bonded substrate material. The product combines good storage characteristics with excellent product dissolution characteristics under European and US laundering conditions.

7 Claims, No Drawings

LAUNDRY PRODUCTS

TECHNICAL FIELD

The invention relates to laundry products. In particular, it relates to laundry products suitable for cleaning or conditioning fabrics and which contain a laundry composition in particulate form.

BACKGROUND

There have been a number of proposals in the art for marketing granular detergent and other laundry compositions in packages, each of which contain a suitable amount of the composition for a single wash under conventional conditions. These proposals include using closed sachets or bags of water-soluble film-forming materials such as polyvinyalcohol and methyl cellulose; and also water-insoluble but water-permeable materials such as paper and woven or non-woven fabrics. The latter approach in particular has a number of attractions; for example, it ensures that the detergent ingredients are released directly into the wash liquor in close proximity to the wash load; it avoids loss of detergent within the dispenser and sump of the washing machine; and it provides for greater convenience in use. Despite the technical and consumer advantages, however, packages of this type have not been commercially successful, a major problem being the difficulty in making products strong enough for satisfactory transport and storage properties while permitting the contents to disperse and dissolve in the wash liquor very quickly without leaving residues in the sachet or bag under all possible conditions of use, inclusive of short wash times, high fabric load and low wash liquor volumes.

Accordingly, the present invention provides a laundry product containing pre-measured amounts of laundry actives in a convenient sachet or pouch-form having acceptable storage characteristics as well as excellent product dissolution characteristics under typical European and U.S. laundering conditions.

SUMMARY OF THE INVENTION

According to the present invention, there is provided a laundry product which comprises a particulate laundry composition releasably contained within a closed single- or multi-compartment sachet having a frangible seal, the sachet being formed of a water-insoluble, calender-bonded or calender-finished, non-woven bonded substrate material.

The laundry products of the invention comprise a sachet and particulate laundry composition. In preferred embodiments the laundry composition takes the form of a particulate detergent composition and the laundry product is designed for addition to the wash cycle of a domestic automatic washing machine.

The sachet itself is formed of a water-insoluble, non-woven bonded substrate material which, critically, has been subjected to a calender-bonding or finishing step. In highly preferred embodiments the substrate is thermo-bonded and has been subjected to calender-finishing. As used herein, the term "calender-finishing" refers to a process of finishing a non-woven bonded substrate material in which the substrate is passed through the running-nip between one or more co-acting pairs of rollers, preferably at an elevated working temperature, and wherein preferably at least one roller is of the smooth variety so as to provide substrate smoothing on at least one side thereof (i.e. so-called smooth-roll calendering). Although moiré calenders comprising coacting pairs of embossed and smooth rollers are also suitable for use herein, in highly preferred embodiments, the coacting pair of rollers are both of the smooth variety so as to provide substrate smoothing on both sides thereof. Preferably, the working temperature of the calender is chosen so as to allow for partial softening of the thermoplastic fiber components of the bonded substrate during the calendering process. Where single-sided smooth-roll calendering is used, the substrate is incorporated in the final laundry product with its smooth side innermost.

In other suitable although less preferred embodiments, the substrate can also be subjected to calendering as part of the bonding process itself. In one process, at least one of the rollers is heated and the substrate web is heated to a temperature at which the thermoplastic components of the web soften or melt. These thermoplastic components can for example be bonding fibers or meltable powders, film or filament yarn. When pressure is applied at the same time, those matrix fibers which do not soften or melt at the working temperature become bonded to the softened thermoplastic substances and to other matrix fibers of the substrate web.

The basis weight of the non-woven bonded substrate material is preferably from about 10 to about 100 grams/sq meter, more preferably from about 30 to about 70 grams/sq meter. Preferred materials for use herein are nonwoven fabrics which are of the thermo-bonded fibrous or filamentous variety. In general, these can have either carded fiber structure (where the fiber strength is suitable to allow carding) or comprise fibrous mats, in which the fibers or filaments are distributed haphazardly or in random array (i.e. an array of fibers in a carded web wherein partial orientation of the fibers is frequently present as well as completely haphazard distributional orientation) or are substantially aligned. The fibers or filaments are preferably synthetic (e.g. rayon, cellulose, ester, or polyesters or mixtures thereof) but can include a content of natural fibers (e.g. wool, silk, wood pulp, jute, hemp, cotton, linen, sisal, or ramie). In highly preferred embodiments however the fibers or filaments are made of or include a content of polyester fibers or bicomponent fibers having a polyester core and for example, a polyethylene sheath.

Generally, non-woven substrates suitable herein are made by air or water laying processes in which the fibers or filaments are first cut to desired lengths and then deposited onto a screen through which the fiber-laden air or water is passed. The deposited fibers or filaments can then be adhesively or thermo-bonded together, dried, cured and calender-finished to form the non-woven cloth. Alternatively, the non-woven cloths can be spun-bonded, spun-laced or melt-blown. Preferred non-woven substrates herein however are prepared by air-laying.

If desired, the sachet can be provided with more than one separate compartment for different laundry ingredients, or the sachets may be formed in a conjoined manner, for example in a strip with individual sachets separated by perforations to facilitate dosing of different numbers of the sachets as appropriate for the wash conditions. The use of multi-compartment sachets facilitates the use of incompatible laundry ingredients in laundry compositions, whilst avoiding encapsulation or other treatment to prevent contact between such ingredients in a single composition.

The sachets can be formed of one or more sheets of non-woven substrate material, but they are preferably made of a single folded sheet or two sheets of the material bonded together at the edges to form a frangible seal. For example, the sachets can be rectangular in shape formed from single folded sheets and sealed on three sides so that on addition to water the seals are broken and the bags open completely to revert to the single sheet of the material of which they are constructed. In another embodiment, the sachet can take the form of a laminate which is bonded together along seal lines arranged as to define one or more closed, non-connecting pockets. The precise disposition of the seal lines, of course, will depend upon the desired design of the sachet. In general, however, the sachet will be sealed along all its free edges and it may also have additional transverse or longitudinal seals as appropriate.

The frangible seal or seals are most conveniently formed using heat-bondable, water-soluble or water-dispersible adhesive. Suitable adhesives can, for example, be based on polysaccharides such as starch or dextrin, synthetic polymers such as polvinyl alcohol, polyvinylpyrrolidone or polyethyleneoxide, or alkali metal silicates. Small amounts of plasticisers, for example ethylene glycol, can be added to the adhesives, if desired. The adhesive may be applied as a hot-melt or powder or may be solvent-carried.

The laundry products of the invention also comprise a particulate laundry composition, especially a granular or powder-form detergent composition incorporating organic surfactant, detergency builder and detergency adjuncts such as bleaches etc.

A wide range of organic surfactants can be incorporated in the laundry composition inclusive of anionic, cationic, ampholytic and zwitterionic detersive surfactants and mixtures thereof. The total level of these materials is generally from about 2% to about 40%, preferably from about 5% to about 25% by weight of the total laundry composition.

Suitable synthetic anionic surfactants are water-soluble salts of $C_8$–$C_{22}$ alkyl benzene sulphonates, $C_8$–$C_{22}$ alkyl sulphates, $C_{10-18}$ alkyl polyethoxy ether sulphates, $C_{8-24}$ paraffin sulphonates, alpha- $C_{12-24}$ olefin sulphonates, alpha-sulphonated $C_6$–$C_{20}$ fatty acids and their esters, $C_{10}$–$C_{18}$ alkyl glyceryl ether sulphonates, fatty acid monoglyceride sulphates and sulphonates, especially those prepared from coconut oil, $C_8$–$C_{12}$ alkyl phenol polyethoxy ether sulphates, 2-acyloxy $C_9$–$C_{23}$ alkane-1-sulphonate, and beta-alkyloxy $C_8$–$C_{20}$ alkane sulphonates.

A particularly suitable class of anionic surfactants includes water-soluble salts, particularly the alkali metal, ammonium and alkanolammonium salts or organic sulphuric reaction products having in their molecular structure an alkyl or alkaryl group containing from about 8 to about 22, especially from about 10 to about 20 carbon atoms and a sulphonic acid or sulphuric acid ester group. (Included in the term "alkyl" is the alkyl portion of acyl groups).

Examples of this group of synthetic detergents are the sodium and potassium alkyl sulphates, especially those obtained by sulphating the higher alcohols ($C_{8-18}$) carbon atoms produced by reducing the glycerides of tallow or coconut oil and sodium and potassium alkyl benzene sulphonates, in which the alkyl group contains from about 9 to about 15, especially about 11 to about 13, carbon atoms, in straight chain or branched chain configuration, e.g. those of the type described in U.S. Pat. Nos. 2,220,099 and 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulphonates in which the average of the alkyl group is about 11.8 carbon atoms, abbreviated as $C_{11.8}$ LAS, and $C_{12}$–$C_{15}$ methyl branched alkyl sulphates.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred.

Suitable fatty acid soaps herein can be selected from the ordinary alkali metal (sodium, potassium), ammonium, and alkylolammonium salts of higher fatty acids containing from about 8 to about 24, preferably from about 10 to about 22 and especially from about 16 to about 22 carbon atoms in the alkyl chain. Fatty acids in partially neutralized form are also suitable for use herein, especially in liquid compositions. Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from tallow and hydrogenated fish oil.

Mixtures of anionic surfactants are particularly suitable herein, especially mixtures of sulphonate and sulphate surfactants in a weight ratio of from about 5:1 to about 1:5, preferably from about 5:1 to about 1:1, more preferably from about 5:1 to about 1.5:1. Especially preferred is a mixture of an alkyl benzene sulphonate having from 9 to 15, especially 11 to 13 carbon atoms in the alkyl radical, the cation being an alkali metal, preferably sodium; and either an alkyl sulphate having from 10 to 20, preferably 12 to 18 carbon atoms in the alkyl radical or an ethoxy sulphate having from 10 to 20, preferably 10 to 16 carbon atoms in the alkyl radical and an average degree of ethoxylation of 1 to 6, having an alkali metal cation, preferably sodium.

Nonionic surfactants suitable herein are condensates of ethylene oxide with a hydrophobic moiety to provide a surfactant having an average hydrophilic-lipophilic balance (HLB) in the range from about 8 to 17, preferably from about 9.5 to 13.5, more preferably from about 10 to about 12.5.

Examples of suitable nonionic surfactants include the condensation products of primary or secondary aliphatic alcohols having from 8 to 24 carbon atoms, in either straight chain or branched chain configuration, with from 2 to about 40 moles, preferably 2 to about 9 moles of ethylene oxide per mole of alcohol. Preferably, the aliphatic alcohol comprises between 9 and 18 carbon atoms and is ethoxylated with between 2 and 9, desirably between 3 and 8 moles of ethylene oxide per mole of aliphatic alcohol. The preferred surfactants are prepared from primary alcohols which are either linear (such as those derived from natural fats or, prepared by the Ziegler process from ethylene, e.g. myristyl, cetyl, stearyl alcohols), or partly branched such as the Lutensols, Dobanols and Neodols which have about 25% 2-methyl branching (Lutensol being a Trade Name of BASF, Dobanol and Neodol being Trade Names of Shell), or Synperonics, which are understood to have about 50% 2-methyl branching (Synperonic is a Trade Name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-9, Dobanol 91-2.5, Dobanol 91-3, Dobanol 91-4, Dobanol 91-6, Dobanol 91-8, Dobanol 23-6.5, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms.

Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule.

Other suitable nonionic surfactants include the condensation products of $C_6$–$C_{12}$ alkyl phenols with from about 3 to 30, preferably 5 to 14 moles of ethylene oxide, and the compounds formed by condensing ethylene oxide with a hydrophobic base formed by the condensation of propylene oxide with propylene glycol, such synthetic nonionic detergents being available on the market under the Trade Name of "Pluronic" supplied by Wyandotte Chemicals Corporation.

Especially preferred nonionic surfactants for use herein are the $C_9$–$C_{15}$ primary alcohol ethoxylates containing 3–8 moles of ethylene oxide per mole of alcohol, particularly the $C_{12}$–$C_{15}$ primary alcohols containing 6–8 moles of ethylene oxide per mole of alcohol.

Cationic surfactants suitable for use herein include quaternary ammonium surfactants and surfactants of a semi-polar nature, for example amine oxides. Suitable quaternary ammonium surfactants are selected from mono $C_{8-C16}$, preferably $C_{10}$–$C_{14}$ N-alkyl or alkenyl ammonium surfactants wherein remaining N positions are substituted by methyl, hydroxyethyl or hydroxypropyl and the corresponding di-$C_6$–$C_{10}$ N-alkyl or alkenyl ammonium surfactants. Suitable amine oxides are selected from mono $C_8$–$C_{20}$, preferably $C_{10}$–$C_{14}$ N-alkyl or alkenyl amine oxides and propylene-1,3-diamine dioxides wherein the remaining N positions are again substituted by methyl, hydroxyethyl or hydroxypropyl.

Suitable builder salts useful herein can be of the polyvalent inorganic and polyvalent organic types, or mixtures thereof. The level of these materials is generally from about 15% to about 90%, preferably from about 20% to about 60% by weight of the total laundry composition. Non-limiting examples of suitable water-soluble, inorganic alkaline builder salts include the alkali metal carbonates, borates, phosphates, pyrophosphates, tripolyphosphates and bicarbonates.

Organic builder/chelating agents that can be incorporated include organic polycarboyxlates and aminopolycarboyxlates and their salts, organic phosphonate derivatives such as those disclosed in U.S. Pat. Nos. 3,213,030, 3,433,021, 3,292,121 and 2,599,807, and carboxylic acid builder salts such as those disclosed in U.S. Pat. No. 3,308,067.

Preferred chelating agents include citric acid, nitrilotriacetic (NTA) and ethylenediamine tetra acetic acids (EDTA), hydroxyethylethylenediaminetriacetic acid (HEEDTA), nitrilo(trimethylene phosphonic acid) (NTMP), ethylenediamine tetra(methylene phosphonic acid) (EDTMP) and diethylenetriamine penta(methylene phosphonic acid) (DETPMP) and salts thereof. Mixtures of organic and/or inorganic builders can be used herein. One such mixture of builders is disclosed in CA-A-755,038, e.g. a ternary mixture of sodium tripolyphosphate, trisodium nitrilotriacetate, and trisodium ethane-1-hydroxy-1,1-diphosphonate.

A further class of builder salts is the insoluble alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at 6, the molar ratio of z to y is in the range from 1.0 to about 0.5 and x is an integer from about 15 to about 264. Compositions incorporating builder salts of this type form the subject of GB-A- No. 1,429,143, DE-A- No. 2,433,485, and DE-A- No. 2,525,778.

The laundry compositions herein can be supplemented by all manner of detergent and laundering components.

An alkali metal, or alkaline earth metal, silicate can also be present. The alkali metal silicate is preferably from about 3% to about 15% by weight of the total composition. Suitable silicate solids have a molar ratio of $SiO_2$/alkali metal$_2$O in the range from about 0.5 to about 3.3, more preferably from about 1.0 to about 2.0.

The laundry compositions herein can also contain bleaching components. In general, the bleach is selected from inorganic peroxy salts, hydrogen peroxide, hydrogen peroxide adducts, and organic peroxy acids and salts thereof. Suitable inorganic peroxygen bleaches include sodium perborate mono- and tetrahydrate, sodium percarbonate, sodium persilicate, urea-hydrogen peroxide addition products and the clathrate $4Na_2SO_4{:}2H_2O_2{:}1NaCl$. Suitable organic bleaches include peroxylauric acid, peroxyoctanoic acid, peroxynonanoic acid, peroxydecanoic acid, diperoxydodecanedioic acid, diperoxyazelaic acid, mono- and diperoxyphthalic acid and mono- and diperoxyisophthalic acid and salts (especially the magnesium salts) thereof. The bleaching agent is generally present at a level of from about 5% to about 35%, preferably from about 10% to about 25% by weight of total laundry composition. Peroxyacid bleach precursors suitable herein are disclosed in UK-A- No. 2040983, highly preferred being peracetic acid bleach precursors such as tetraacetylethylene diamine, tetraacetylmethylenediamine, tetraacetylhexylenediamine, sodium p-acetoxybenzene sulphonate, tetraacetylglycouril, pentaacetylglucose, octaacetyllactose, methyl O-acetoxy benzoate, sodium 3,5,5-trimethylhexanoyloxybenzene sulfonate, sodium 3,5,5-trimethylhexanoyloxybenzoate, sodium 2-ethylhexanoyloxybenzenesulfonate, sodium nonanoyloxybenzenesulfonate and sodium octanoyloxybenzenesulfonate. The level of bleach precursor is generally from about 0.5% to about 10%, preferably from about 1% to about 6% by weight of the total composition.

Other optional components of the compositions herein include suds suppressors, enzymes, fluorescers, photoactivators, soil suspending agents, anti-caking agents, pigments, perfumes, fabric conditioning agents etc.

Suds suppressors are represented by materials of the silicone, wax, vegetable and hydrocarbon oil and phosphate ester varieties. Suitable silicone suds controlling agents include polydimethylsiloxanes having a molecular weight in the range from about 200 to about 200,000 and a kinematic viscosity in the range from about 20 to about 2,000,000 $mm^2/s$, preferably from about 3000 to about 30,000 $mm^2/s$, and mixtures of siloxanes and hydrophobic silanated (preferably trimethylsilanated) silica having a particle size in the range from about 10 millimicrons to about 20 millimicrons and a specific surface area above about 50 $m^2/g$. Suitable waxes include microcrystalline waxes having a melting point in the range from about 65° C. to about 100° C., a molecular weight in the range from about 4000-1000, and a penetration value of at least 6, measured at 77° C. by ASTM-D1321, and also paraffin waxes, synthetic waxes and natural waxes. Suitable phosphate esters include mono- and/or di-$C_{16}$–$C_{22}$ alkyl or alkenyl phosphate esters, and the corresponding mono- and/or di alkyl or alkenyl ether phosphates containing up to 6 ethoxy groups per molecule.

Enzymes suitable for use herein include those discussed in U.S. Pat. Nos. 3,519,570 and 3,533,139. Suitable fluorescers include Blankophor MBBH (Bayer AG) and Tinopal CBS and EMS (Ciba Geigy). Photoactivators are discussed in EP-A- No. 57088, highly preferred materials being zinc phthalocyanine, tri- and tetra-sulfonates. Suitable fabric conditioning agents include smectite-type clays as disclosed in GB-A- No. 1400898 and di-$C_{12}$–$C_{24}$ alkyl or alkenyl amines and ammonium salts.

Antiredeposition and soil suspension agents suitable herein include cellulose derivatives such as methylcellulose, carboxyethylcellulose and hydroxyethylcellulose, and homo- or co-polymeric polycarboxylic acids or their salts in which the polycarboxylic acid comprises at least two carboxyl radicals separated from each other by not more than two carbon atoms. Polymers of this type are disclosed in GB-A-No.1,596,756. preferred polymers include copolymers or salts thereof of maleic anhydride with ethylene, methylvinyl ether, acrylic acid or methacrylic acid, the maleic anhydride constituting at least about 10 mole percent, preferably at least about 20 mole percent of the copolymer. These polymers are valuable for imp roving whiteness maintenance, fabric ash deposition, and cleaning performance on clay, proteinaceous and oxidizable soils in the presence of transition metal impurities.

In the preferred embodiments, the laundry compositions herein have a bulk density of at least about 0.5g/cc, preferably at least about 0.6g/cc, and more preferably at least about 0.7g/cc. In the case of multi-compartment sachets, bulk density is measured on an individual compartment basis. Thus, the contents of at least one compartment or set of compartments should meet the preferred bulk density limitations. In highly preferred embodiments, however, at least about 50%, and more preferably at least about 80% by weight of the laundry composition is in one or more compartments meeting the bulk density parameters.

The laundry compositions are preferably made by spray-drying an aqueous slurry comprising anionic surfactant and detergency builder to a density of at least about 0.3g/cc, spraying-on nonionic surfactant, where present, and comminuting the spray-dried granules in for example a Patterson-Kelley twin shell blender. The aqueous slurry for spray drying preferably comprises from about 30% to about 60% water and from about 40% to about 70% of the detergency builder; it is heated to a temperature of from about 60° C. to about 90° C. and spray dried in a current of air having an inlet temperature of from about 200° C. to about 400° C., preferably from about 275° C. to about 350° C., and an outlet temperature of from about 95° C. to about 125° C., preferably from about 100° C. to about 115° C. The weight average particle size of the spray dried granules is from about 0.15 to about 3 mm, preferably from about 0.5 mm to about 1.4 mm. After comminution, the weight average particle size is from about 0.1 to about 0.5 mm, preferably from about 0.15 to about 0.4 mm.

In the final laundry product, the total volume of laundry composition will normally lie in the range of from 60 to about 400 cc, preferably from about 100 to 300 cc and more preferably from about 200 to about 260 cc, product volume being defined as product weight-/bulk density. The volume of composition in any given compartment of the sachet will naturally depend on the product design and in particular on the number of compartments per sachet. In twin compartment sachets, for example, each compartment will preferably comprise from about 50 to about 150 cc, more preferably from about 100 to about 130 cc of product. Multi-compartment sachets containing as many as 25 to 100 compartments are within the scope of the invention, however, in which case the compartments can contain individually from about 1 cc to about 15 cc, preferably from about 3 cc to about 9 cc of product.

In the Examples, the abbreviations used have the following designation:

| | |
|---|---|
| LAS | Linear $C_{12}$ alkyl benzene sulphonate |
| TAS | Tallow alkyl sulphate |
| $C_{14/15}AS$ | Sodium $C_{14}$–$C_{15}$ alkyl sulphate |
| $TAE_n$ | Hardened tallow alcohol ethoxylated with n moles of ethylene oxide per mole of alcohol |
| $C_{12}TMAB$ | $C_{12}$ alkyl trimethyl ammonium bromide |
| Dobanol 45-E-7 | A $C_{14}$–$C_{15}$ primary alcohol condensed with 7 moles of ethylene oxide, marketed by Shell |
| Clay | Sodium montmorillonite |
| INOBS | Sodium 3,5,5-trimethyl hexanoyl oxybenzene sulphonate |
| TAED | Tetraacetylethylenediamine |
| DPDA | Diperoxydodecanedioic acid (30%); boric acid/ sulphate mixture (70%) |
| PPA | Peroxyphthalic acid, magnesium salt |
| Silicone/Silica | 85:15 mixture of polydimethylsiloxane and silanated silica prilled with STPP and $TAE_{80}$ |
| Enzyme | Savinase prills |
| STPP | Sodium tripolyphosphate |
| Zeolite | Zeolite 4A |
| Metasilicate | Sodium metasilicate |
| $Na_2CO_3$ | Sodium carbonate |
| Silicate | Sodium silicate ($SiO_2$:$Na_2O$ = 1.6:1) |
| Perborate | Anhydrous sodium perborate bleach of empirical formula $NaBO_2.H_2O_2$ |
| Percarbonate | Sodium percarbonate |
| MA/AA | Maleic acid/acrylic acid copolymer, 1:3 mole ratio, m.wt. 70,000 |
| EDTA | Sodiumethylenediaminetetraacetate |
| Brightener | Disodium 4,4'-bis(2-morpholino-4-anilino-s-triazin-6-ylamino)stilbene-2:2'- |

-continued

| | |
|---|---|
| | disulphonate |
| EDTMP | Ethylenediamine tetra(methylene phosphonic acid), marketed by Monsanto, under the Trade name Dequest 2041 |

EXAMPLES I TO VI

Six laundry products are prepared as follows:

A base powder composition is first prepared by mixing all components except Dobanol 45E7, bleach, bleach activator, enzyme, suds suppressor, phosphate and carbonate in a crutcher as an aqueous slurry at a temperature of about 55° C. and containing about 35% water. The slurry is then spray dried at a gas inlet temperature of about 330° C. to form base powder granules and the granules are comminuted in a Patterson-Kelley twin shell blender. The bleach activator where present, is then admixed with $TAE_{25}$ as binder and extruded in the form of elongate particles through a radial extruder as described in European Patent Application No. 62523. The bleach activator noodles, bleach, enzyme, suds suppressor, phosphate and carbonate are then dry-mixed with the base powder composition and finally Dobanol 45E7 is sprayed into the final mixture. Each composition had a bulk density of about 0.7 g/cc.

| | I | II | III | IV | V | VI |
|---|---|---|---|---|---|---|
| LAS | 5 | 8 | 8 | 3 | 4 | 9 |
| TAS | — | — | 3 | — | 4 | 3 |
| $C_{14/15}AS$ | 5 | 8 | — | 1 | — | — |
| $TAE_{25}$ | 0.5 | 0.3 | 0.5 | 0.2 | 0.8 | 0.5 |
| $C_{12}TMAB$ | 2 | — | — | — | 2 | — |
| Dobanol 45-E-7 | 2 | 2 | 4 | 10 | 4 | — |
| Clay | — | 6 | — | — | 4 | 7 |
| INOBS | — | 2 | 4 | — | — | 3 |
| TAED | 3 | — | 0.5 | — | 2 | — |
| Silicone/Silica | 0.2 | 0.2 | 0.4 | 0.8 | 0.4 | 0.5 |
| Enzyme | 0.5 | 0.6 | 0.7 | 0.8 | 0.5 | 0.6 |
| STPP | 9 | — | 25 | — | 24 | 10 |
| Zeolite | 12 | 18 | — | 22 | — | 10 |
| Metasilicate | — | — | — | — | — | 5 |
| $Na_2CO_3$ | 5 | — | 8 | — | — | 5 |
| Silicate | 5 | 6 | 10 | 6 | 6 | — |
| Perborate | 10 | — | 14 | — | — | 12 |
| Percarbonate | — | — | — | — | 20 | — |
| MA/AA | 4 | 3 | 2 | 2 | 4 | 2 |
| EDTA | 0.5 | 0.5 | 0.5 | 0.5 | 0.5 | 0.5 |
| Brightener | 0.2 | 0.2 | 0.2 | 0.2 | 0.2 | 0.2 |
| EDTMP | 0.2 | 0.1 | 0.2 | 0.3 | 0.2 | 0.1 |
| Sulphate, moisture | | | To 100 | | | |

A twin-compartment sachet is made from a non-woven, air-laid, thermally-bonded substrate material having a basis weight of 50 g/sq meter and which was formed of crimped polyester/polyethylene bicomponent fibers wherein the polyester and polyethylene components have a softening temperature of 230°–240° C. and 105°–120° C. respectively, the substrate having been finished by calendering between coacting, twin smoothing rollers at a working temperature of 125° C. The substrate material is first coated overall with poly(ethyleneoxide) by melt extrusion at a coating weight of 40 g/sq meter. A sheet of the substrate measuring 120 mm×80 mm is then folded midway along its long dimension with the poly(ethyleneoxide) inwards, the sheet is heat-sealed along the two opposing free edges and along a longitudinal seam parallel to and half-way between the two opposing edges, the two compartments are filled with 120 cc each of detergent composition I and then heat sealed along the open edge of the sachet. The procedure is then replicated five times using composition II to VI respectively. The resulting laundry products have acceptable storage characteristics under high humidity conditions as well as excellent dissolution characteristics under typical European and U.S. laundering conditions compared with corresponding products in which the substrate material has not been treated to calender-finishing.

EXAMPLES VII TO VIII

The procedure of Examples I to VI is repeated using compositions II and IV but in each instance, only one compartment of the twin-compartment sachet is filled with the detergent composition, the other compartment being filled with 14 g of 30% active DPDA (Example VII) or 10 g of PPA (Example VIII) respectively. The resulting products again have acceptable storage characteristics under high humidity conditions as well as excellent dissolution characteristics under typical European and U.S. laundering conditions.

We claim:

1. A laundry product which consisting of a particulate laundry composition releasably contained within a closed, single- or multi-compartment sachet having a frangible seal, the sachet being formed of a water-insoluble, calender-bonded or calender-finished non-woven bonded substrate material which is a thermo-bonded fibrous or filamentous substrate wherein the fibers or filaments are of polyester or a polyester core bonded with a polyethylene sheath.

2. A product according to claim 1 wherein the non-woven substrate material is finished by smooth-roll hot calendaring.

3. A laundry product according to claim 1 in which said frangible seal is formed of a water-soluble or water-dispersible adhesive.

4. A product according to claim 3 wherein the sachet is formed of a folded rectangular sheet with three edge seals.

5. A product according to claim 3 wherein the adhesive is heat-bondable.

6. A laundry product according to claim 1 wherein the sachet is coated internally with a water-soluble or water-dispersible adhesive.

7. A product according to claim 6 wherein the seal is formed of a water-soluble or water-dispersible adhesive.

* * * * *